US009506191B2

(12) United States Patent
Erkelenz et al.

(10) Patent No.: US 9,506,191 B2
(45) **Date of Patent: *Nov. 29, 2016**

(54) SUCTION ROLL FOR A MACHINE FOR PRODUCING AND/OR PROCESSING A PAPER, CARDBOARD OR TISSUE WEB

(71) Applicant: VOITH PATENT GMBH, Heidenheim (DE)

(72) Inventors: Marc Erkelenz, Ulm (DE); Jochen Honold, Schlingen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/421,329

(22) PCT Filed: Aug. 9, 2013

(86) PCT No.: PCT/EP2013/066671

§ 371 (c)(1),
(2) Date: Feb. 12, 2015

(87) PCT Pub. No.: WO2014/026913

PCT Pub. Date: Feb. 20, 2014

(65) Prior Publication Data

US 2016/0002854 A1 Jan. 7, 2016

(30) Foreign Application Priority Data

Aug. 15, 2012 (DE) ..... 10 2012 214 531

(51) Int. Cl.
*D21F 5/14* (2006.01)
*D21F 3/10* (2006.01)

(52) U.S. Cl.
CPC ..... *D21F 5/143* (2013.01); *D21F 3/10* (2013.01)

(58) Field of Classification Search
CPC ..... D21F 5/14; D21F 3/10; D21F 7/00
USPC ..... 162/372, 371
See application file for complete search history.

(56) References Cited

U.S. PATENT DOCUMENTS

| | | | | |
|---|---|---|---|---|
| 2,290,777 | A | 7/1942 | Street | |
| 2,969,837 | A | 1/1961 | Reynar | |
| 6,395,137 | B1 * | 5/2002 | Snellman | D21F 3/10 162/369 |
| 6,592,721 | B1 * | 7/2003 | Anderson | D21F 3/10 162/274 |
| 2004/0168603 | A1 * | 9/2004 | Boga | C09K 3/10 101/494 |
| 2015/0191872 | A1 * | 7/2015 | Erkelenz | D21F 3/10 277/500 |
| 2015/0204014 | A1 * | 7/2015 | Erkelenz | D21F 3/10 277/300 |
| 2015/0218753 | A1 * | 8/2015 | Erkelenz | D21F 3/10 492/28 |

* cited by examiner

*Primary Examiner* — Mark Halpern
(74) *Attorney, Agent, or Firm* — Laurence A. Greenberg; Werner H. Stemer; Ralph E. Locher

(57) ABSTRACT

A roller has a movable roller sleeve and a positive-pressure or negative-pressure zone inside the roller sleeve. The zone is sealed outwardly by a sealing installation with at least one sealing strip. The sealing strip in the radial direction of the roller is movable from the roller toward the inner side and away therefrom and the sealing strip has a lubricant outlet opening connected to a supply line for delivering lubricant to between the inner side of the roller sleeve and the sealing face. The supply line includes one part running within the sealing strip and one part running outside the sealing strip but within the roller. The part of the supply line within the roller, on its length which is routed outside the sealing strip, includes a first portion that is longer than a second line portion. The second line portion is more flexural than the first line portion.

20 Claims, 3 Drawing Sheets

SUCTION ROLL FOR A MACHINE FOR PRODUCING AND/OR PROCESSING A PAPER, CARDBOARD OR TISSUE WEB

This application is a 371 of PCT/EP2013/066671 filed 9 Aug. 2013.

BACKGROUND OF THE INVENTION

Field of the Invention

The invention relates to a roller having a positive-pressure or negative-pressure zone within the roller sleeve and rotationally fixed in comparison with the roller sleeve and which is sealed in relation to the environment by means of a sealing installation which comprises at least one sealing strip. The sealing strip in the radial direction of the roller is movable from the roller toward the inner side and away there from and the sealing strip, in the region of its sealing face which points toward the inner side of the movable roller sleeve, comprises at least one lubricant outlet opening which is connected to a supply line and by means of which lubricant is deliverable between the inner side of the roller sleeve and the sealing face, wherein the supply line includes one part which runs within the sealing strip and one part which runs outside the sealing strip but within the roller.

Sealing installations in suctioned or blown rollers for paper, cardboard, or tissue machines have to reliably seal the positive-pressure or negative-pressure zone in relation to the environment where normal pressure is prevalent. In order to seal the positive-pressure or negative-pressure zone, the sealing face of each sealing strip of the sealing installation is placed against the inner side of the rotating roller sleeve. In order to reduce wear of the sealing strip which is caused by friction between the sleeve face and the sealing face, introduction of a lubricant between the sealing face and the inner side is attempted. This is usually effected using injection pipes which in the rotation direction of the roller are disposed ahead of the first sealing strip of the positive-pressure or negative-pressure zone. Here, the lubricant is applied to the inner side of the roller sleeve, conveyed by the latter by way of its rotation to the individual sealing strips, on account of which the supply of lubricant decreases from one sealing strip to the next, when viewed in the rotation direction. In order to nevertheless supply the sealing strips which follow in the rotation direction with sufficient lubricant, a large amount of lubricant which, however, only benefits a small part of the lubrication of the sealing strips per se and otherwise contributes toward undesirable rehumidification of the fibrous web has to be used.

In order to solve this problem, an invention of the applicant proposes to directly route the lubricant to the upper side of the respective sealing strip that provides the sealing face, in order to thus supply the required amount of lubricant to each individual sealing strip in a targeted manner. One preferred design embodiment of this invention here furthermore proposes a lubricant channel in the form of a groove-like depression which is provided on the upper side of the roller and disposed beside the sealing face and which extends in the longitudinal direction of the sealing strip, that is to say in the cross-machine direction of the roller.

Since the sealing strip has to be movable in the radial direction of the roller toward the inner side of the roller sleeve and away therefrom, this freedom of movement of the sealing strip must not be hampered by the supply line by means of which the lubricant is conveyed to the lubricant channel.

BRIEF SUMMARY OF THE INVENTION

It is now the object of the present invention to propose a roller having a sealing strip with an integrated lubricant supply which is not limited in its freedom of movement in relation to a sealing strip not having an integrated lubricant supply.

The object is achieved by a roller for a machine for a machine for manufacturing or processing a fibrous web, wherein the roller comprises a movable roller sleeve and a positive-pressure or negative-pressure zone which is disposed within the roller sleeve and is rotationally fixed in comparison with the roller sleeve and which is sealed in relation to the environment by means of a sealing installation which comprises at least one sealing strip, wherein the sealing strip in the radial direction of the roller is movable from the roller toward the inner side of the roller sleeve and away therefrom and the sealing strip, in the region of its sealing face which points toward the inner side of the movable roller sleeve, comprises at least one lubricant outlet opening which is connected to a supply line and by means of which lubricant is deliverable between the inner side of the roller sleeve and the sealing face, wherein the supply line includes one part which runs within the sealing strip and one part which runs outside the sealing strip but within the roller.

The invention is characterized in that the part of the supply line which runs within the roller, on its length which is routed outside the sealing strip, includes a first and second line portion, wherein the first line portion is longer than the second line portion, and the second line portion is configured so as to be more flexural in comparison with the first line portion.

On account of the flexural short second line portion free displaceability of the sealing strip in relation to the inner side of the roller sleeve thereto or therefrom in the radial direction of the roller is ensured. The first line portion of the part of the supply line which runs within the roller but outside the sealing strip may be implemented so as to be flexurally rigid and thus stable. In conceptualizing and arranging the flexural second line portion, particular attention has to be paid so that the latter does not abrade on components within the roller in the event of the sealing strip moving.

Advantageous design embodiments and refinements of the invention are stated in the dependent claim The more flexurally rigid first line portion may be implemented using one or a plurality of steel pipes, for example. The more flexural second line portion may be implemented using one or a plurality of plastic hoses, in particular rubber hoses, which may be reinforced by a metal fabric or braiding, for example.

It is, in particular, conceivable for the flexurally rigid first line portion to commence at the at least one roller end and to extend in the roller in the direction of the sealing strip. It is furthermore conceivable for the flexural second line portion to commence at a spacing of at most one meter from the at least one point at which the supply line is routed out of the sealing strip. It is conceivable for the more flexural second line portion to have a length of 15 cm to 200 cm, in particular 20 cm to 150 cm.

It is conceivable for the supply line to be routed out of the roller in the region of at least one longitudinal roller end of the roller. It is furthermore conceivable for each of the two roller ends to comprise one roller cap and for the supply line to be routed out of the roller at at least one of the roller caps.

The flexural second line portion preferably commences at the point at which the supply line is routed out of the sealing strip.

The supply line preferably displays a fourth line portion which is integral with or unreleasably connected to the sealing strip—the central supply duct and the at least one riser line may belong to the fourth line portion, for example—as well as a third line portion which is releasably connected to the fourth line portion and which runs outside the sealing strip and is preferably routed to at least one of the two roller ends. On account thereof it is enabled that in the case of maintenance or replacement, for example, the sealing strip can be readily connected to the lubricant supply and separated therefrom again.

Preferably, in the region of the at least one point at which the connection line is routed out of the sealing strip, at least one connection element, for example in the form of a bush which is sealed by an O-ring, by means of which the third line portion and the fourth line portion are releasably interconnected is preferably provided; that is to say that according to this embodiment, the fourth line portion substantially extends within the sealing strip and terminates at the connection element. The third line portion then is routed outside the sealing strip and is releasably connected to the fourth line portion by way of the at least one connection element. It is quite possible for the fourth line portion to run within the sealing strip in such a branched manner that the former is routed out of the sealing strip at a plurality of points which, for example, are disposed beside one another in the longitudinal direction of the sealing strip. In this case, in the region of each point at which a branch of the fourth line portion is routed out of the sealing strip one connection element by means of which the respective branch is connected to the third line portion is preferably disposed.

The third line portion is preferably composed of the first and second line portions.

A further preferred design embodiment of the invention provides that the sealing installation comprises a sealing-strip holder for holding the sealing strip, wherein the sealing-strip holder has a holding portion having at least one guide face along which the sealing strip with at least one of the two sides of the front or rear end side is mounted so as to be displaceable to and from the inner side of the roller sleeve face when viewed in the radial direction of the roller, wherein the supply line at at least one point on one of the two end sides is routed out of the sealing strip, and wherein the holding portion has at least one clearance through which that portion of the supply line which is routed out of the end side of the sealing strip is routed through the sealing-strip holder, and wherein the at least one clearance is configured in such a manner that the sealing strip together with the portion of the supply line which is routed out therefrom is movable along the path in relation to the sealing-strip holder.

It is conceivable for the at least one clearance to be configured so as to be hole-shaped or a groove which is open toward the top.

The sealing strip preferably comprises an upper side which faces the inner side of the roller sleeve and which provides the sealing face and the at least one lubricant outlet opening. It is also conceivable here for the at least one lubricant outlet opening to be configured as a lubricant channel in the form of a groove-like depression in the material of the sealing strip, which is formed in the material of the sealing strip and in its longitudinal extent extends in the longitudinal direction of the sealing strip. It is also conceivable in this context for the sealing strip to be delimited in its length by two ends, wherein the sealing strip in the region of its two ends displays in each case one wall which delimits the lubricant channel in its length.

On account of the lubricant channel being closed off in its length on both sides, it is configured in a tub-like manner, on account of which a level of lubricant which is uniform across the length of the lubricant channel may arise and the lubricant channel forms a type of reservoir for the lubricant. On account thereof, a substantially constant level of lubricant may be maintained even in the event of variable dispensing of lubricant through the supply line. On account thereof, the amount of lubricant required may be further reduced and the fail-safe running properties in the case of a brief failure of the lubricant supply may be improved.

Preferably, the lubricant channel substantially extends across the majority of the length of the sealing strip. Substantially here is to mean that the lubricant channel extends across at least 60%, preferably at least 70% of the length of the sealing strip. The lubricant channel here may extend in an uninterrupted manner. Preferably the two walls which delimit the lubricant channel in its length have a thickness of at most 20 cm, preferably at most 10 cm, when viewed in the longitudinal direction of the sealing strip. In the case of a common sealing strip this may mean that the lubricant channel extends across a plurality of meters, whereas the two walls at the ends of the sealing strip in each case extend across at most 20 cm, in particular at most 10 cm.

In order to design the construction of the sealing installation with respect to the connection of the supply line to the sealing strip in a simple manner and to nevertheless ensure uniform deployment of the lubricant across the length of the sealing strip, a preferred design embodiment of the invention provides that the supply line comprises a central supply duct which extends within the sealing strip along the longitudinal direction thereof, and at least one, preferably a plurality of, riser line(s) which interconnect the lubricant channel and the central supply duct, and via which the lubricant channel is fed with the lubricant by way of outlet openings of the respective riser line which terminate in the lubricant channel. According to this design embodiment, the central supply duct can be fed with the lubricant by way of one infeed line or a few infeed lines. The central supply duct then distributes the lubricant to a plurality of riser lines, wherein the number of riser lines is significantly higher than the number of infeed lines. It is conceivable in this context for an outlet opening to be disposed about every 5 to 500 mm when viewed in the longitudinal direction of the sealing strip.

In order to be able to further homogenize the deployment of the amount of lubricant and to here provide a solution in terms of construction and production technology, a further advantageous design embodiment of the invention provides that the central supply duct, along its longitudinal extent, has a variable cross-sectional area and/or cross-sectional geometry. Such a central supply duct having a variable cross section is particularly easy to manufacture in that, for example, first a groove which is open toward one of the long sides of the main body, for example a U-shaped groove, is introduced into the main body of the sealing strip, the opening of said groove then being partially closed off using sealing-strip material by means of a profiled body which replicates the width and length but not the depth of the groove, for example. This profiled body may then be fastened on the main body by adhesive bonding, for example, and then, together with the latter, configure a duct providing the central supply duct.

In order to achieve an effective lubricating effect, a preferred design embodiment of the invention provides that the sealing face and the lubricant channel are disposed on the upper side in such a manner that, when viewed in the envisaged rotation direction of the roller sleeve, the lubricant channel is upstream of the substantial part of the sealing face, in particular that the lubricant channel is upstream of the sealing face. On account thereof, it is achieved that the inner side of the roller sleeve, before running onto the sealing face or at least the substantial part of the sealing face, is wetted with the lubricant. It may be specifically provided that, when viewed in the rotation direction of the roller sleeve, the roller sleeve runs onto the sealing strip on the front end side, first sweeps the lubricant channel and subsequently the sealing face, and then runs off from the sealing strip at the rear end side.

When viewed in a sectional plane which is perpendicular to the longitudinal extent of the sealing strip, the lubricant channel displays a base which forms the lowest point of the lubricant channel having a front side wall which extends to the front end face and a rear side wall which extends to the sealing face. The front side wall here extends up to the front end face, and the rear side wall extends up to the sealing face. It is preferably provided for the rear side wall to enclose angle of 1° to 89°, in particular an angle between 15° or more and 80° or less, with a horizontal.

On account thereof, a cuneiform gap is formed between the upper side of the sealing strip and the inner side of the roller sleeve, which gap is largest on the front end side and tapers off toward the sealing face. On account thereof, a suction effect is achieved by the air entrained by the rotating roller sleeve, which suction effect draws the lubricant into the space between the inner side of the roller face and the sealing face.

According to a specific design embodiment of the invention, upon installation and operation of the sealing installation in the roller according to the intended use, when viewed in the radial direction of the roller, the rear end side extends closer to the inner side of the roller sleeve than the front end side, in particular, the rear end side extends up to the inner side of the roller sleeve, whereas the front end side does not extend up to the inner side of the roller sleeve.

Preferably, the lubricant is substantially water. The term "substantially" refers here to the potential possibility of adding lubricant additives to the water, wherein water always represents the major component of such a mixture (in relation to percent per volume).

According to one potential design embodiment of the invention, the front side and the rear side of the sealing strip extend so as to be substantially parallel with one another.

BRIEF DESCRIPTION OF THE SEVERAL VIEWS OF THE DRAWING

The invention will be explained further by means of schematic not-to-scale drawings, in which.

DESCRIPTION OF THE INVENTION

Figure 1:
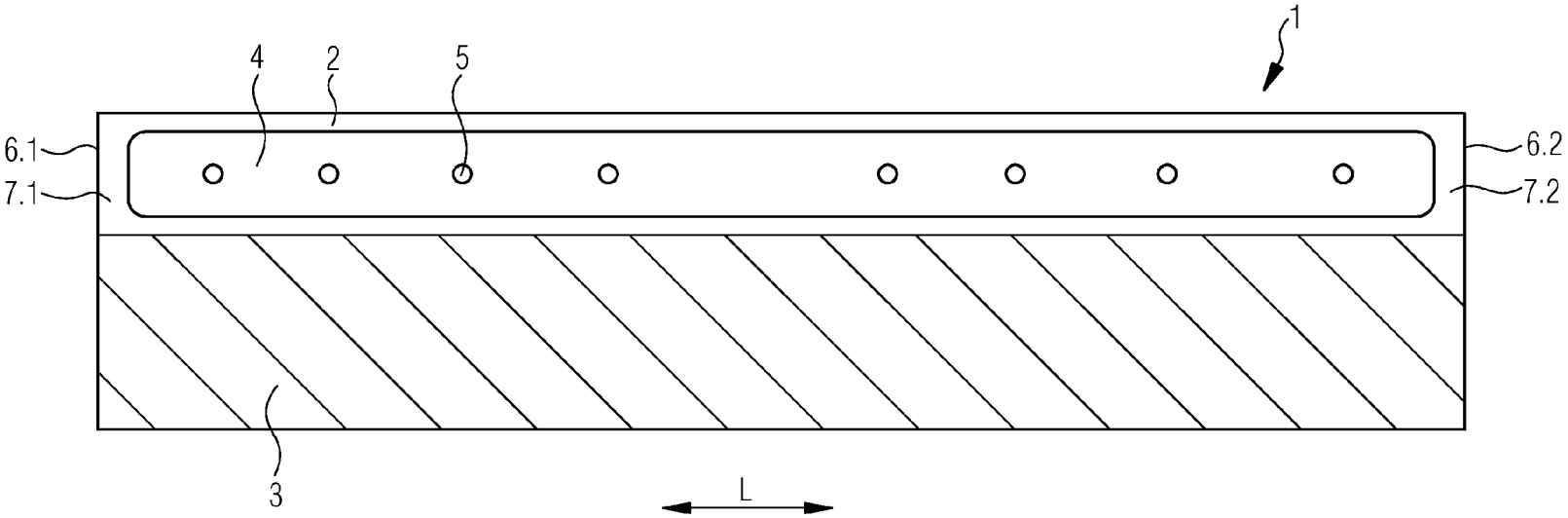
FIG. 1 shows a sealing strip of a sealing installation according to the invention, in a plan view.

FIG. 1 shows a sealing strip 1 of a sealing installation according to the invention, in a plan view onto the upper side 2 of the sealing strip 1 which points toward the inner side of a rotatable roller sleeve.

The upper side 2 of the sealing strip 1 provides a sealing face 3 which is drawn using hatched lines, and a lubricant channel 4 which adjoins the sealing face 3, wherein the lubricant channel is formed by a groove-like depression in the sealing strip, which extends in the longitudinal direction L of the sealing strip 1, and the sealing face 3 and the opening of the lubricant channel 4 face toward the inner side of the roller sleeve. It should be noted at this point that the longitudinal direction L of the sealing strip 1 and the longitudinal direction of the roller coincide and are individually as well as collectively indicated using the reference sign L. The length of the sealing strip 1 is to be understood to be its maximum extent in the longitudinal direction L.

As can be derived from the illustration of FIG. 1, a multiplicity of openings 5 of a supply line 12 for supplying lubricant, which are disposed behind one another in the longitudinal direction of the lubricant channel 4 terminate in the lubricant channel 4. The sealing strip 1 is delimited in its length by two ends 6.1 and 6.2. The sealing strip 1, in the region of its two ends 6.1 and 6.2, displays in each case one wall 7.1 and 7.2, delimiting the lubricant channel 4 in its length. The sealing strip 1 has a length of a plurality of meters, and each of the two walls 7.1 and 7.2, when viewed in the longitudinal direction L of the sealing strip 1, has a thickness of 20 cm or less, in particular 10 cm or less.

Figure 2:
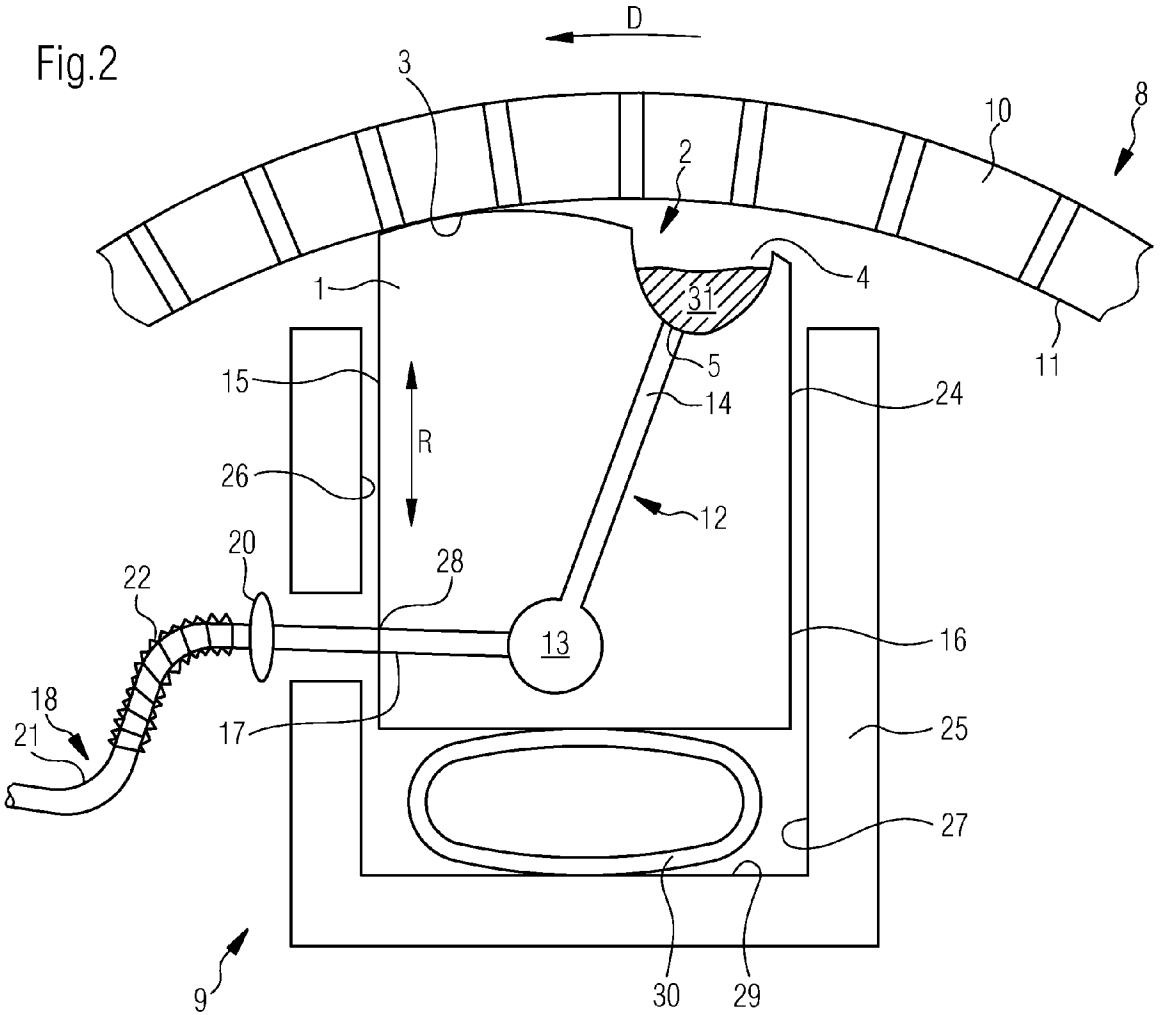
FIG. 2 shows a roller according to the invention in a sectional plane which is perpendicular to the longitudinal extent of the roller, having the sealing strip of FIG. 1.
Figure 3:
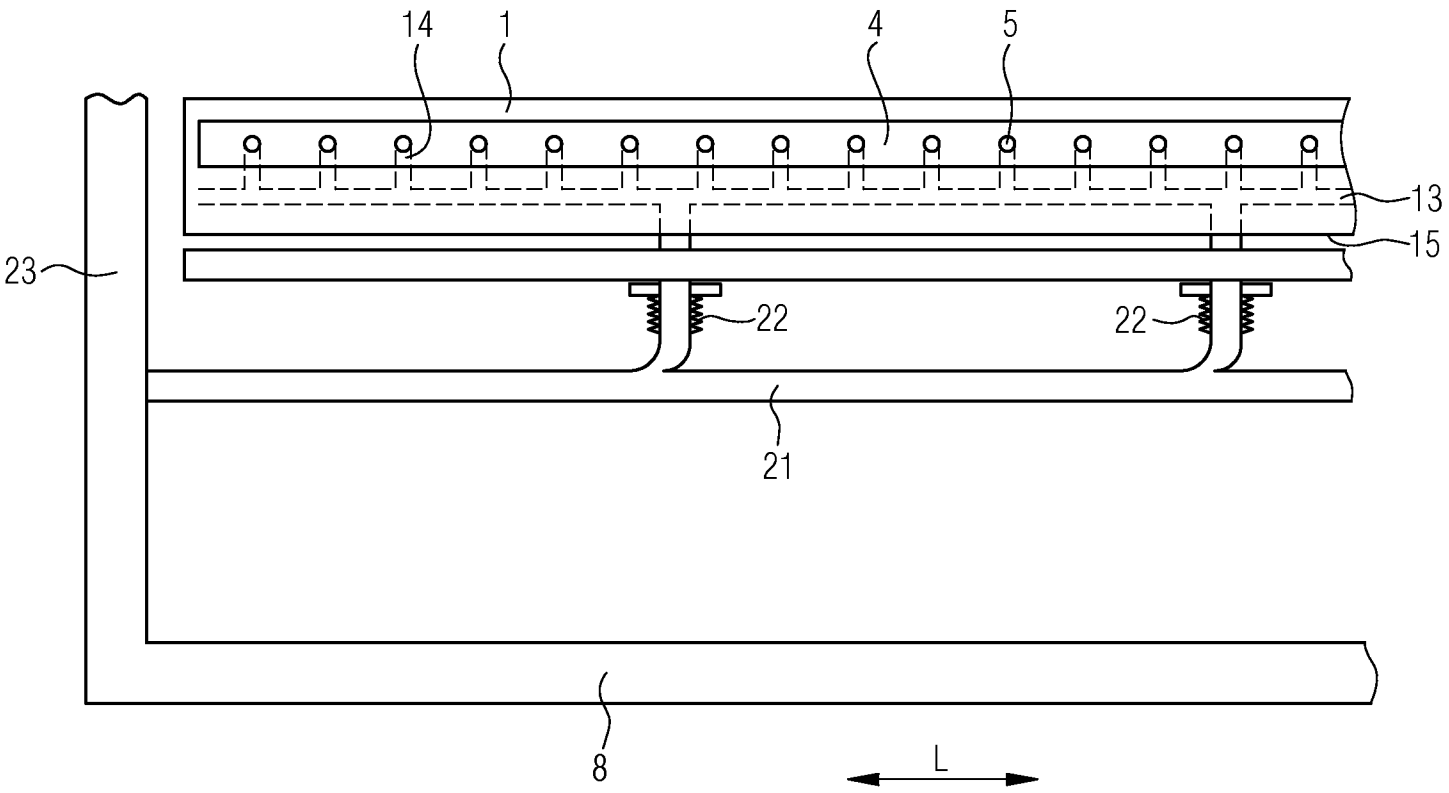
FIG. 3 shows a detail of the roller of FIG. 2 in the region of one of its longitudinal ends, in plan view.

FIG. 2 shows a roller 8 according to the invention, in a sectional plane which is perpendicular to the longitudinal extent L of the roller 1. A sealing installation 9, having the sealing strip 1 shown in FIG. 1, is installed in the roller 8 according to the intended use. FIG. 2 shows the sealing installation 9 having the sealing strip 1 in the position in which the sealing face 3 thereof is placed against the inner side 11 of the roller sleeve 10, in order to seal a positive-pressure zone or negative-pressure zone (not shown). FIG. 3 shows a roller end on the longitudinal side in a plan view, without an illustration of the roller sleeve, wherein components which run within the roller 8 are drawn using dashed lines.

The lubricant channel 4 is connected to a supply line 12 which in portions runs within the sealing strip 1 and which, on the side of the sealing strip, terminates at the openings 5 and by means of which lubricant 31, which is located in the lubricant channel 4, is deliverable between the inner side 11 of the roller sleeve 10 and the sealing face 3.

As can be derived from the illustration of FIG. 2, the sealing face 3 and the lubricant channel 4 are disposed on the upper side 2 in such a manner that during rotation of the roller sleeve 10 in the envisaged rotation direction D, the lubricant channel is upstream of the substantial part, in the present case even upstream of the entire sealing face 3.

The sealing strip 1, in its width B, is delimited by a front end side 24 and a rear end side 15 which runs substantially parallel therewith, the upper side 2 of the sealing strip 1 extending therebetween. Here, the front and rear end sides 24, 15, and the sealing face 3, and the lubricant channel 4, are disposed in such a manner that during rotation of the roller sleeve 10 when viewed in the envisaged rotation direction D, the roller sleeve 10 runs onto the sealing strip 1 in the region of the front end side 24, initially sweeps the lubricant channel 4 and subsequently the sealing face 3, so as to run off the sealing strip 1 in the region of the rear end side 15.

One can furthermore see that, when viewed in the radial direction R of the roller 8, the rear end side 15 extends so as to be closer to the inner side 11 of the roller sleeve 10 than the front end side 24, on account of which an inlet gap is formed between the upper side 2 of the sealing strip 1 and the inner side 11 of the roller sleeve 10 in the region of the front end side 24.

The sealing installation 9 furthermore comprises a sealing-strip holder 25 for holding the sealing strip 1. The sealing-strip holder 25 here in the present case has a holding portion having two guide faces 26, 27 on which the sealing strip by way of its two sides 15, 24 is displaceably mounted, so as to be displaceable from the front or rear end side in the radial direction R of the roller 8 along a path from and to the inner side 11 of the roller sleeve face 10. The sealing-strip holder 25 furthermore has a base 29 on which a bellows 30, which is filled with a pressure medium such as, for example, air, is supported and by means of which the sealing strip 1 is movable in relation to the sealing-strip holder 25 in the direction R.

It furthermore can be identified that the supply line 12 is routed out of the sealing strip 1 at at least one point 28 at the rear end side 15. In order to ensure free displaceability of the sealing strip 1 in relation to the sealing-strip holder 25, when viewed in the radial direction R of the roller 8, the holding portion has at least one clearance 32 which is configured so as to be hole-shaped and through which the portion of the supply line 12 which is in each case routed out of the rear end side 15 of the sealing strip 1 is routed through the sealing-strip holder 25.

As can be identified from the illustration of FIG. 2, the supply line 12 comprises a portion which is routed within the sealing strip, and a portion which is routed outside the sealing strip 1. The portion of the supply line 12 which is routed within the sealing strip 1 comprises a central supply duct 13 which extends in the longitudinal direction L of the sealing strip 1 and from which a plurality of riser lines 14 which are disposed behind one another in the longitudinal direction L of the sealing strip 1 and which in each case terminate at an opening 5 in the lubricant channel 4 emanate. One or a plurality of in this case horizontally routed line portions which on the rear end side 15 of the sealing strip 1 is/are routed out of the sealing strip 1 branch off from the central supply duct 13. It is conceivable that the central supply duct 13 along its longitudinal extent L has a variable cross-sectional area and/or cross-sectional geometry.

The portion of the supply line 12 which runs outside of the sealing strip 1 but within the roller 8 comprises a first line portion 21 and a second line portion 22, as shown in FIGS. 2 and 3. Here, the first line portion 21 is longer than the second line portion 22, and the second line portion 22 is configured according to the invention so as to be flexural in comparison with the first line portion 21. In the present case, the second line portion 22 is formed by a rubber hose with a reinforcement of a metal braiding 22. Furthermore, the second line portion 22 commences in a region of at most one meter calculated from the point 28 at which the supply line 12 is routed out from the sealing strip 1 and has a length of 20 to 100 cm. The first line portion 21 terminates at one of its longitudinal ends at a longitudinal roller end 23, which is configured as a roller cap, for example, and at its other longitudinal end at a connecting piece 20.

The first and the second line portions 21, 22 together form a third line portion 18. That part of the supply line 12 that runs within the sealing strip 1, and a short line piece which runs between the central supply duct 13 and the point 28 form a fourth line portion 17. The fourth line portion 17 is unreleasably connected to the sealing strip 1 and forms an integral part of the latter. Since it is a fixed component of the sealing strip 1, here the fourth line portion 17 is removed and installed along with the sealing strip 1 when the latter is removed or installed. The third and the fourth line portions 18, 17, are releasably interconnected by way of the connecting element 20.

The invention claimed is:

1. A roller for a machine for manufacturing or processing a fibrous web, the roller comprising:

a movable roller sleeve and a positive-pressure or negative-pressure zone formed inside said roller sleeve and rotationally fixed relative to said roller sleeve;

a sealing installation configured to seal said positive-pressure or negative-pressure zone relative to an environment, said sealing installation having at least one sealing strip disposed for movement in a radial direction relative to the roller radially inwardly and away therefrom;

said sealing strip having a sealing face toward an inner side of said movable roller sleeve, said sealing face having at least one lubricant outlet opening formed therein;

a supply line connected to said at least one lubricant opening for delivering lubricant to between the inner side of said movable roller sleeve and said sealing face, said supply line including a first part running within said sealing strip and a second part running outside said sealing strip but within the roller;

said second part of said supply line that runs within the roller, on a length which is routed outside said sealing strip, includes a first line portion and a second line portion, said first line portion being longer than said second line portion and said second line portion more flexural than said first line portion; and said supply line including a fourth line portion connected to said sealing strip and a third line portion releasably connected to said fourth line portion, said supply line including a connection element configured for releasably interconnecting said third and fourth line portions.

2. The roller according to claim 1, wherein said supply line is routed out of the roller at a longitudinal roller end of the roller.

3. The roller according to claim 2, wherein said first line portion commences at the roller end and extends in the roller in a direction of said sealing strip, and/or said second line portion commences in a region of at most one meter from a point at which said supply line is routed out of said sealing strip.

4. The roller according to claim 1, wherein said second line portion has a length in a range from 15 cm to 200 cm.

5. The roller according to claim 4, wherein said second line portion has a length in a range from 20 cm to 150 cm.

6. The roller according to claim 1, wherein said fourth line portion is non-releasably connected to said sealing strip.

7. The roller according to claim 6, wherein said connection element is disposed in a region of the at least one point at which said supply line is routed out of said sealing strip.

8. The roller according to claim 1, wherein:

said sealing installation comprises a sealing-strip holder for holding said sealing strip, said sealing-strip holder having a holding portion with at least one guide face on which said sealing strip with at least one of two sides of a front or rear end side is mounted so as to be displaceable along a path when viewed in the radial direction of the roller;

said supply line at at least one point on at least one of the two sides of the front and rear end sides is routed out of said sealing strip and said holding portion has at least one clearance through which that portion of said supply line which is routed out of the at least one side of the front or rear end side of said sealing strip is routed through said sealing-strip holder; and the at least one clearance is configured so that said sealing strip together with the portion of said supply line which is routed out therefrom is movable along the path in relation to said sealing-strip holder.

9. The roller according to claim 8, wherein said at least one clearance is formed in a shape of a hole or an upwardly open groove.

10. The roller according to claim 1, wherein said sealing strip comprises an upper side facing the inner side of said roller sleeve and which includes the sealing face and the at least one lubricant outlet opening.

11. The roller according to claim 1, wherein said at least one lubricant outlet opening is a lubricant channel formed as a groove-shaped depression in said sealing strip, said groove-shaped depression being formed in a material of said sealing strip and having a longitudinal extent extending in a longitudinal direction of said sealing strip.

12. The roller according to claim 11, wherein said sealing strip is delimited in a length thereof by two ends, and said sealing strip, at said two ends, having in each case one wall which delimits a length of said lubricant channel.

13. The roller according to claim 1, wherein said supply line comprises a central supply duct extending within said sealing strip along a longitudinal direction thereof, and at least one riser line interconnecting said lubricant channel and said central supply duct.

14. The roller according to claim 13, wherein said central supply duct, along a longitudinal extent thereof, has a variable cross-sectional area and/or cross-sectional geometry.

15. The roller according to claim 1, wherein said sealing strip has a central portion with a length amounting to a plurality of meters and each end portion thereof has a length of 20 cm or less.

16. The roller according to claim 15, wherein each end portion has a length of 10 cm or less.

17. The roller according to claim 1, wherein said sealing strip has a width delimited by one front and one rear end side, the upper side of said sealing strip extending therebetween, and, during rotation of the roller sleeve, said roller sleeve runs onto said sealing strip on the front end side and runs off on the rear end side, and wherein said lubricant channel is disposed between the front end side and the sealing face.

18. A sealing installation according to claim 1, wherein the lubricant channel, when viewed in a sectional plane perpendicular to the longitudinal extent of the sealing strip, has a lowest point, a front side wall extending therefrom in the direction of the front end side and a rear side wall extending therefrom in the direction of the sealing face, wherein the upper edge of the front side wall adjoins the front end side and the upper edge of the rear side wall adjoins the sealing face, and wherein, upon installation of the sealing installation in the roller according to claim 1, a straight line interconnecting the two upper edges and the horizontal encloses an angle of 1° to 89°.

19. The sealing installation according to claim 18, wherein the straight line interconnecting the two upper edges enclosed an angle of between 15° and 80° with the horizontal.

20. The roller according to claim 1, wherein said fourth line portion is integral with or non-releasably connected to said sealing strip.

* * * * *